US011832781B2

(12) United States Patent
Han et al.

(10) Patent No.: US 11,832,781 B2
(45) Date of Patent: Dec. 5, 2023

(54) CYCLONE DUST COLLECTOR AND VACUUM CLEANER HAVING THE SAME

(71) Applicant: Samsung Electronics Co., Ltd., Suwon-si (KR)

(72) Inventors: Jung Gyun Han, Suwon-si (KR); Won Min Lee, Suwon-si (KR); Chang Hyun Lee, Suwon-si (KR); Shin Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 370 days.

(21) Appl. No.: 17/108,754

(22) Filed: Dec. 1, 2020

(65) Prior Publication Data

US 2021/0076891 A1 Mar. 18, 2021

Related U.S. Application Data

(63) Continuation of application No. 15/770,462, filed as application No. PCT/KR2016/011632 on Oct. 17, 2016, now Pat. No. 10,869,587.

(30) Foreign Application Priority Data

Oct. 21, 2015 (KR) ..... 10-2015-0146550

(51) Int. Cl.
*A47L 9/20* (2006.01)
*A47L 9/16* (2006.01)

(52) U.S. Cl.
CPC ..... *A47L 9/20* (2013.01); *A47L 9/1608* (2013.01); *A47L 9/1675* (2013.01); *A47L 9/1691* (2013.01)

(58) Field of Classification Search
CPC .... A47L 9/1608; A47L 9/1675; A47L 9/1691; A47L 9/20
See application file for complete search history.

(56) References Cited

U.S. PATENT DOCUMENTS 5,271,751 A * 12/1993 Lagler ..... B01D 50/20 55/516
6,824,580 B2 * 11/2004 Oh ..... B04C 5/22 15/352

(Continued)

FOREIGN PATENT DOCUMENTS

CN 1319372 A 10/2001
CN 1440715 A 9/2003

(Continued)

OTHER PUBLICATIONS

Office Action dated Oct. 9, 2021 in connection with Chinese Patent Application No. 201680059711.3, 13 pages.

(Continued)

*Primary Examiner* — Marc Carlson

(57) ABSTRACT

Disclosed is a cyclone dust collector in which usability is improved. A vacuum cleaner comprising a cyclone dust collector, wherein the cyclone dust collector includes, a case configured to swirl suctioned air to separate dust from the suctioned air and accommodate the separated dust, a grill assembly separably installed in the case, and a cleaning portion included in the case and configured to remove dust adhered to a surface of the grill assembly when the grill assembly is separated from the case.

15 Claims, 9 Drawing Sheets

(56) References Cited

U.S. PATENT DOCUMENTS

| | | | | |
|---|---|---|---|---|
| 6,928,692 | B2 * | 8/2005 | Oh | A47L 9/1666 55/299 |
| 6,948,212 | B2 * | 9/2005 | Oh | A47L 5/28 15/328 |
| 7,152,277 | B2 * | 12/2006 | Jung | B04C 9/00 15/352 |
| 7,318,848 | B2 * | 1/2008 | Lee | B01D 46/2411 55/284 |
| 7,494,520 | B2 * | 2/2009 | Nam | B01D 46/0046 15/352 |
| 2001/0025395 | A1 * | 10/2001 | Matsumoto | A47L 9/1683 55/447 |
| 2001/0052166 | A1 | 12/2001 | Park et al. | |
| 2003/0159235 | A1 * | 8/2003 | Oh | A47L 9/20 15/352 |
| 2004/0187253 | A1 * | 9/2004 | Jin | A47L 9/20 15/352 |
| 2016/0287042 | A1 * | 10/2016 | Han | A47L 9/20 |
| 2018/0310788 | A1 * | 11/2018 | Han | A47L 9/1691 |

FOREIGN PATENT DOCUMENTS

| | | | |
|---|---|---|---|
| CN | 1462603 | A | 12/2003 |
| EP | 1136028 | A2 | 9/2001 |
| EP | 1136028 | A3 | 3/2003 |
| EP | 2813170 | A2 | 12/2014 |
| JP | S59193358 | U | 12/1984 |
| JP | 2003190056 | A | 7/2003 |
| JP | 2003225183 | A | 8/2003 |
| JP | 2003230516 | A | 8/2003 |
| JP | 2003339596 | A | 12/2003 |
| JP | 2005168775 | A | 6/2005 |
| JP | 2006167293 | A | 6/2006 |
| JP | 2011016009 | A | 1/2011 |
| KR | 10-0413988 | B1 | 1/2004 |
| KR | 10-2005-0091821 | A | 9/2005 |
| KR | 10-2008-0061102 | A | 7/2008 |
| KR | 10-2014-0136591 | A | 12/2014 |
| KR | 10-2014-0144890 | A | 12/2014 |

OTHER PUBLICATIONS

Notice of Preliminary Rejection dated Oct. 5, 2021 in connection with Korean Patent Application No. 10-2015-0146550, 8 pages.

The Third Office Action dated May 20, 2021, in connection with Chinese Patent Application No. 201680059711.3, 14 pages.

The Second Office Action dated Dec. 3, 2020 in connection with Chinese Application No. 201680059711.3, 17 pages.

Notice of Final Rejection dated Apr. 1, 2022, in connection with Korean Application No. 10-2015-0146650, 9 pages.

European Search Report dated Jan. 26, 2022, in connection with European Application No. 21196042.2, 5 pages.

ISA/KR, International Search Report and Written Opinion of the International Searching Authority for International Application No. PCT/KR2016/011632, dated Jan. 12, 2017, 14 pages.

European Patent Office, "Supplementary European Search Report," Application No. EP 16857731.0, dated Jul. 11, 2018, 7 pages.

Office Action dated Mar. 17, 2020 in connection with Chinese Patent Application No. 201680059711.3, 19 pages.

Communication of a notice of opposition dated Sep. 7, 2022 in connection with European Patent Application No. 16857731.0, 29 pages.

Communication under Rule 71(3) EPC dated Oct. 5, 2022 in connection with European Patent Application No. 21 196 042.2, 33 pages.

Notice of Patent Allowance dated Aug. 1, 2022 in connection with Korean Patent Application No. 10-2015-0146550, 3 pages.

* cited by examiner

CYCLONE DUST COLLECTOR AND VACUUM CLEANER HAVING THE SAME

CROSS-REFERENCE TO RELATED APPLICATIONS

The present application is a continuation of application Ser. No. 15/770,462, filed Apr. 23, 2018, which is the 371 National Stage of International Application No. PCT/KR2016/011632, filed Oct. 17, 2016, which claims the priority to Korean Application No. 10-2015-0146550, filed Oct. 21, 2015, the disclosures of which are fully incorporated herein by reference into the present disclosure as if fully set forth herein.

BACKGROUND

1. Field

The present disclosure relates to a cyclone dust collector having an improved usability, and a vacuum cleaner including the same.

2. Description of Related Art

Vacuum cleaners are apparatuses configured to perform cleaning by suctioning air using a suction force generated by a fan and a motor and by filtering foreign material included in the suctioned air.

A vacuum cleaner includes a dust collecting unit, in which foreign material is filtered out by a predetermined filtering part, so as to filter out foreign material from suctioned air. A filtering device allowing foreign material to be filtered out by the dust collecting unit includes a porous filter unit in which foreign material is forcibly filtered out while air passes through a porous filter and a cyclone type dust collecting unit in which foreign material is filtered out while the air flows cyclonically.

A cyclone dust collector may be widely used in a canister cleaner, an upright cleaner, handheld cleaner, and the like.

The cyclone dust collector may include an inlet part through which air is introduced and an outlet part thorough which air is discharged to the outside. Dust in the air introduced through the inlet part may be filtered out and the filtered air may be discharged to the outside through the outlet part.

The outlet part may include a grill portion. As air through holes are formed in the grill portion, dust particles of a predetermined size or larger cannot be discharged through the outlet part. Large pieces of dust, hair, and the like may be twined around an outer circumferential surface of the grill portion by air circling in the cyclone dust collector. When the air through holes are clogged by the dust adhered to the outer circumferential surface of the grill portion, a suction force of the vacuum cleaner may be decreased. In addition, there is an inconvenience in that a user removes the dust adhered to the outer circumferential surface of the grill portion using his or her hands by himself or herself.

SUMMARY

The present disclosure is directed to a cyclone dust collector capable of preventing reduction of a suction force and a vacuum cleaner having the same.

In addition, the present disclosure is directed to a cyclone dust collector in which introduced foreign material may be easily removed, and a vacuum cleaner having the same.

In accordance with an aspect of the present disclosure, a vacuum cleaner comprising a cyclone dust collector, wherein the cyclone dust collector includes: a case configured to swirl suctioned air and separate dust from the suctioned air; a grill assembly separably installed in the case; and a cleaning portion included in the case and configured to remove dust adhered to a surface of the grill assembly when the grill assembly is separated from the case.

The cleaning portion is integrally formed with the case.

The cleaning portion is provided to protrude from an inside surface of the case.

An opening through which the grill assembly is inserted is formed in the case.

The cleaning portion is provided at an inside surface of the cover configured to form the opening.

A diameter of the opening is the same as that of the grill assembly inserted into the case.

The cleaning portion is provided to come into contact with the surface of the grill assembly.

The grill assembly includes: a grill portion in which an air passing hole is formed and which is accommodated in the case; and a handle provided at one side of the grill portion.

When the grill assembly is installed in the case, the handle is located outside the case to be manipulable by a user.

An opening is formed in the case; and the grill portion is inserted into the case via the opening.

A coupling protrusion is provided to protrude from an outside surface of the case.

The handle includes an interfering portion interfered with by the coupling protrusion.

The handle includes an insertion portion through which the coupling protrusion passes.

When the coupling protrusion is inserted into the insertion portion and the handle is rotated in one direction, the coupling protrusion is interfered with by the interfering portion and the grill assembly is fixed to the case.

The case includes a cyclone chamber in which introduced air swirls and a dust collecting chamber in which dust in the air is collected.

According to one embodiment, since a user does not need to manually remove dust and the like adhered to an outer circumferential surface of a grill portion, convenient of use can be improved.

In addition, occurrence of secondary contamination around a case can be prevented when dust and the like adhered to an outer circumferential surface of the grill portion is removed.

DETAILED DESCRIPTION

Hereinafter, a cyclone dust collector and a vacuum cleaner having the same according to one embodiment will be described in detail with the accompanying drawings.

Figure 1:
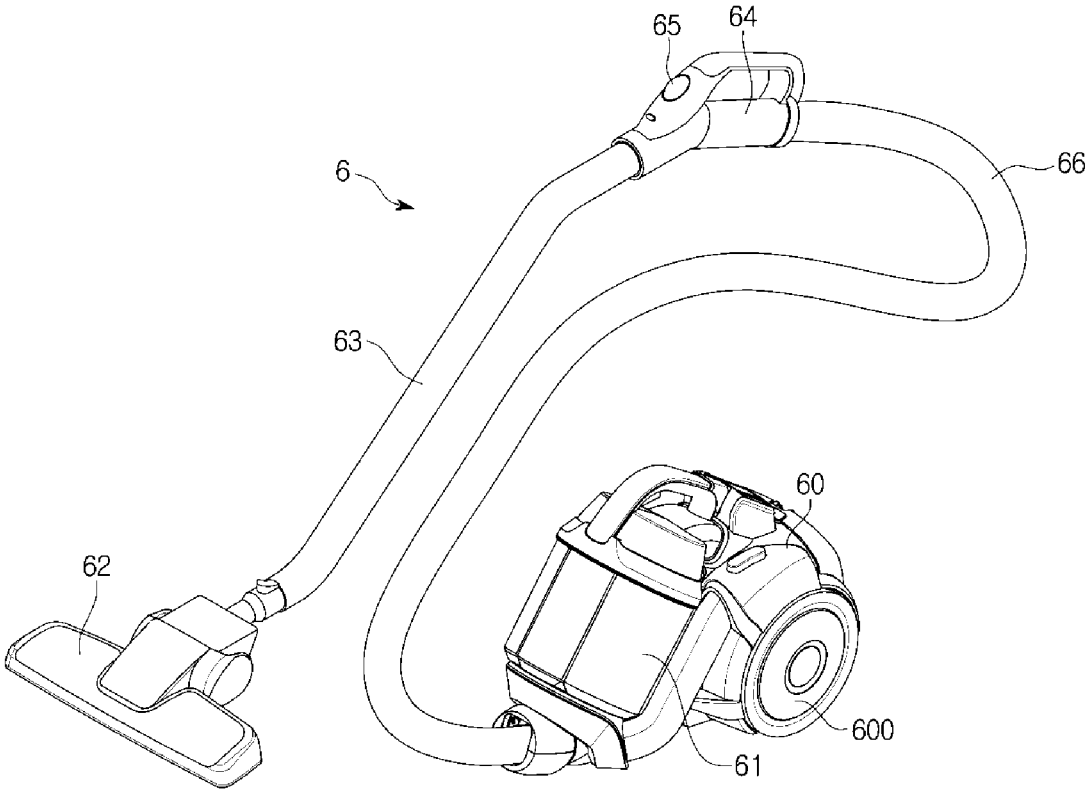
FIG. 1 is a view illustrating a vacuum cleaner according to one embodiment.
Figure 2:
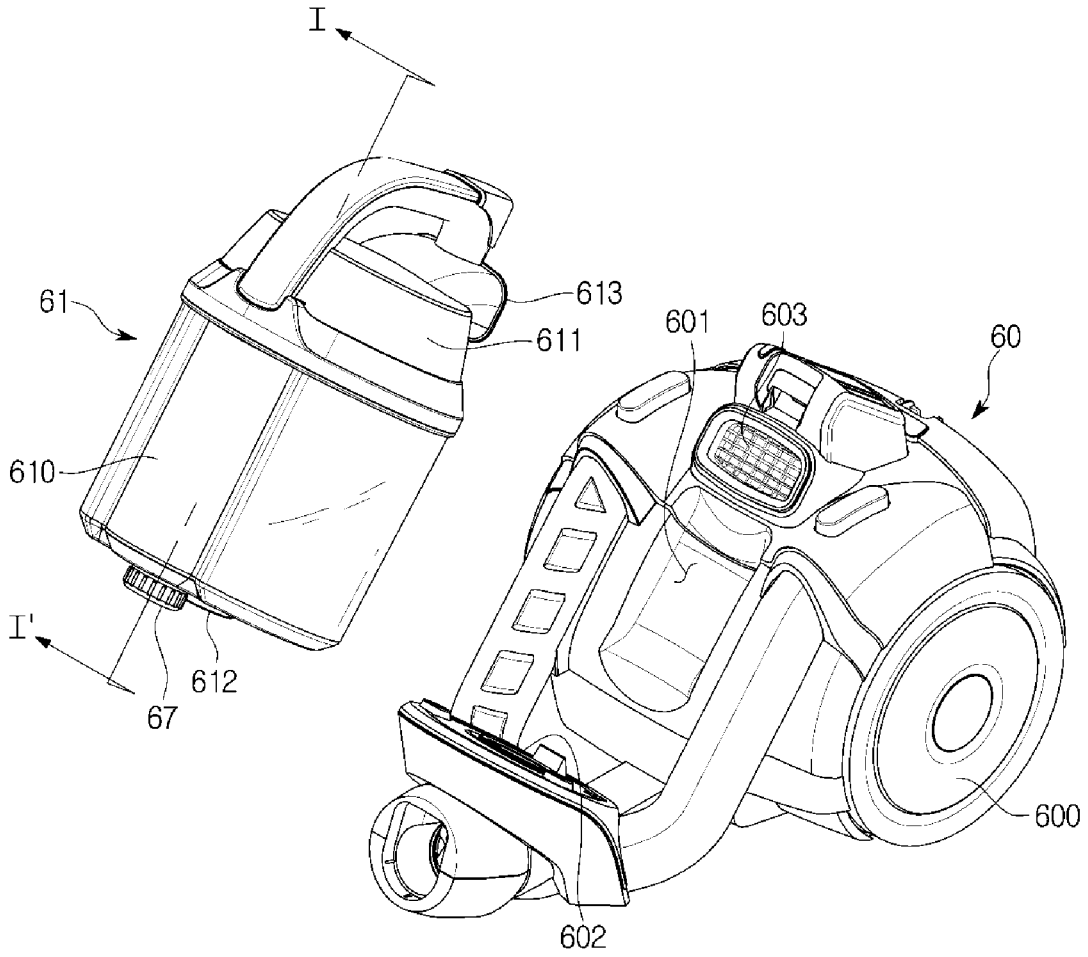
FIG. 2 is a view illustrating an aspect in which a cyclone dust collector is separated from a main body according to one embodiment.

FIG. 1 is a view illustrating a vacuum cleaner according to one embodiment, and FIG. 2 is a view illustrating an aspect in which a cyclone dust collector is separated from a main body according to one embodiment.

Referring to FIGS. 1 and 2, a vacuum cleaner 6 according to the embodiment may be a canister type vacuum cleaner. The vacuum cleaner 6 may include a main body 60, a cyclone dust collector 61 installed in the main body 60, and a suction unit 62 configured to come into contact with air and suction the air. The cyclone dust collector 61 generates a swirling air current and separates air from dust using a centrifugal force.

The main body 60 includes a fan motor (not shown) configured to generate a suction force. The suction unit 62 may suction air and dust included in the air around a target surface using the suction force generated in the main body 60. The suction unit 62 may be formed in a substantially broad shape to closely come into contact with the target surface.

An extending pipe 63 made of a resin or metal material, a handle pipe 64 manipulated by a user, and a flexible hose 66 made of a flexible material such that the handle pipe 64 is freely moved may be interposed between the main body 60 and the suction unit 62. A manipulation portion 65 through which a function of the vacuum cleaner may be controlled may be provided in the handle pipe 64.

All of the suction unit 62, the extending pipe 63, the handle pipe 64, and the flexible hose 66 may be provided to communicate with each other. Accordingly, air suctioned by the suction unit 62 may flow through the suction unit 62, the extending pipe 63, the handle pipe 64, and the flexible hose 66 to the main body 60.

The main body 60 may include a suction port 602 configure to guide suctioned air to the cyclone dust collector 61 and a discharging port 603 configured to discharge air purified in the cyclone dust collector 61. The discharging port 603 may be communicated with a fan motor room (not shown) including the fan motor (not shown).

An installation portion 601 in which the cyclone dust collector 61 is installed may be provided in the main body 60, and the cyclone dust collector 61 may be separably installed in the installation portion 601. The cyclone dust collector 61 separates and collects dust from air suctioned by the suction unit 62, and purified air is discharged via the discharging port 603.

The cyclone dust collector 61 includes an entrance 612*a* through which air including dust is introduced and an exit 613 through which purified air is discharged. When the cyclone dust collector 61 is installed in the main body 60, the entrance 612*a* of the cyclone dust collector 61 may be communicated with the suction port 602 of the main body 60, and the exit 613 of the cyclone dust collector 61 may be communicated with the discharging port 603 of the main body 60.

The main body 60 may include wheels 600 for moving the main body 60. The wheels 600 may be provided at both side surfaces of the main body 60.

The cyclone dust collector 61 may include a case 610 in which a cyclone chamber is formed and an upper cover 611 configured to open and close the case 610. Hereinafter, a specific configuration of the cyclone dust collector 61 will be described.

Figure 3:
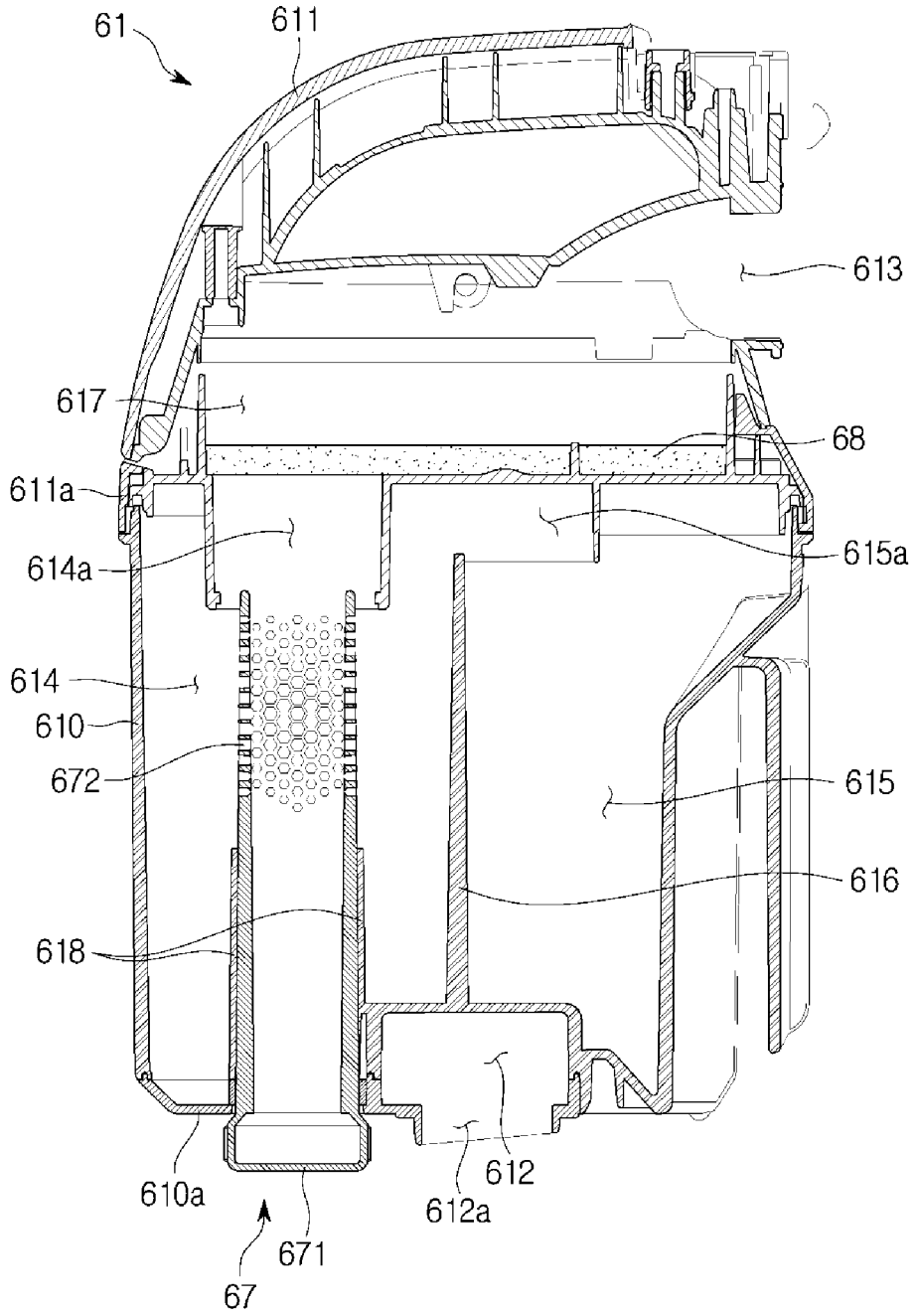
FIG. 3 is a cross-sectional view illustrating the cyclone dust collector according to one embodiment.

FIG. 3 is a cross-sectional view illustrating the cyclone dust collector according to one embodiment.

Referring to FIG. 3, the cyclone dust collector 61 according to one embodiment may include the case 610 having a substantially cylindrical shape, an open lower surface, and an open upper surface, an upper cover 611 provided above the case 610, a middle cover 611*a* interposed between the upper cover 611 and the case 610 to cover the upper surface of the case 610, and the lower cover 610*a* coupled to a lower portion of the case 610 to cover the open lower surface of the case 610.

The middle cover 611*a* may be separably coupled to and cover the upper surface of the case 610. The upper cover 611 may be provided above and rotatively hinge coupled to the middle cover 611*a*.

However, the cyclone dust collector 61 may also be integrally formed. In addition, the shape of the case 610 may also not be the cylindrical shape.

The lower cover 610*a* may be injection molded together with the case 610. Hereinafter, the lower cover 610*a* may be integrally formed with the case 610 and referred to as a bottom surface of the case 610.

The case 610 may be formed of a transparent material for checking an amount of foreign material collected in the case 610. The upper cover 611, the middle cover 611*a*, and the lower cover 610*a* may be formed of a transparent or translucent material.

The case 610 may include a cyclone chamber 614 configured to generate a swirling air current and separate dust using a centrifugal force and a dust collecting chamber 615 configured to collect the dust. The cyclone chamber 614 and the dust collecting chamber 615 may be divided by an inner wall 616. The cyclone chamber 614 is provided in an inner space of the inner wall 616, and the dust collecting chamber 615 may be provided between the inner wall 616 and an outer wall of the case 610.

An opening 615*a* may be provided above one side of the inner wall 616 such that the cyclone chamber 614 may communicate with the dust collecting chamber 615 and dust separated from air in the cyclone chamber 614 may flow to the dust collecting chamber 615. Since dust heavier than air is scattered to an outer side due to a centrifugal force, the opening 615*a* may be formed at a side of a circumference of the cyclone chamber 614.

The cyclone chamber 614 may have a substantially cylindrical shape to generate a swirling air current. A grill assembly 67 may be located in a central portion of the cyclone chamber 614.

The grill assembly 67 may include a cylindrical shaped grill portion 670 accommodated in the cyclone chamber 614, air passing holes 672 formed in the grill portion 670, and a handle 671 provided at one side of the grill portion 670. Air guided to the cyclone chamber 614 may swirl around the grill portion 670. The grill portion 670 may extend from the lower cover 610*a* of the cyclone dust collector 61 to an outlet part 614*a* which will be described below.

An inlet part 612 through which air is introduced to the cyclone chamber 614 and the outlet part 614*a* through which air is discharged from the cyclone chamber 614 may be provided in the cyclone dust collector 61. Air introduced via the dust collector entrance 612*a* of the lower cover 610*a* may flow into the cyclone chamber 614 via the inlet part 612. Air from which dust is removed in the cyclone dust collector 61 may be discharged to the outside via the outlet part 614*a* provided in the central portion of the cyclone chamber 614.

The outlet part 614*a* may have a substantially cylindrical shape having an inner space. The air passing holes 672 may be provided in the grill assembly 67 adjacent to the outlet part 614*a*. Air which swirls inside the cyclone chamber 614 may pass through the air passing holes 672 and may be discharged from the cyclone chamber 614 via the outlet part 614*a*. The air which swirls inside the cyclone chamber 614 and from which dust is removed for a first time by a centrifugal force may pass through the air passing holes 672 and may have dust removed therefrom for a second time.

The middle cover 611*a* may include a fine filter 68 configured to filter out fine dust again in air discharged via the outlet part 614*a*. A filter installation portion 617 including a space in which the fine filter 68 is installed may be provided in the middle cover 68.

The middle cover 611*a* may be separably installed on the case 610. The user may separate the middle cover 611*a* from the case 610 and empty collected dust out of the dust collecting chamber 615.

The fine filter 68 may be a sponge and the like. The fine filter 68 may be separably installed in the filter installation portion 617. An upper portion of the filter installation portion 617 may be covered by the upper cover 611. The filter installation portion 617 may be provided to be opened and closed by the upper cover 611.

As one example, the upper cover 611 may be rotatively installed on the middle cover 611*a*. When the fine filter 68 needs to be cleaned or replaced, the user may open the upper cover 611 and separate the fine filter 68 from the filter installation portion 617. Air repurified through the fine filter 68 may be discharged to the outside of the cyclone dust collector 61 via the exit 613.

The grill assembly 67 may be separably installed on the case 610. When the grill assembly 67 is separated from the case 610, dust adhered to a surface of the grill portion 670 may be interfered with by a cleaning portion 618.

The cleaning portion 618 may be provided to protrude from an inside surface of the lower cover 610*a* forming an opening 612*b* (see FIG. 4) through which the grill assembly 67 is inserted. The cleaning portion 618 may be provided to extend in a direction the same as that in which the grill portion 670 extends. When the grill assembly 67 is separated from the case 610, the grill assembly 67 may be provided to come into contact with the surface of the grill portion 670. A plurality of cleaning portions 618 may be provided. In addition, the lower cover 610*a* and the cleaning portion 618 may be integrally injection molded.

The shape of the cleaning portion 618 is not limited to the shape described above. For example, the surface of the grill portion 670 may be provided to be interfered with by an inside surface of the lower cover 610*a* forming the opening 612*b* through which the grill assembly 67 is inserted. Here, the cleaning portion 618 may be the inside surface of the lower cover 610*a*.

The user may separate the grill assembly 67 from the case 610, and when the grill assembly 67 is separated from the case 610, dust adhered to the surface of the grill portion 670 may be interfered with by the cleaning portion 618 and removed from the grill portion 670. Since the user does not remove the dust adhered to the surface of the grill portion 670 by himself of herself, the cyclone dust collector 61 is easily cleaned and is hygienic.

Hereinafter, operation of the vacuum cleaner according to one embodiment of the present disclosure will be described.

When the fan motor (not shown) of the main body 10 is driven, air surrounding a target surface may be suctioned through the suction unit 62 by a suction force of the fan motor (not shown). The suctioned air may sequentially pass through the extending pipe 63, the handle pipe 64, and the flexible hose 66 and may be introduced into the cyclone dust collector 61 installed in the main body 60.

The air introduced into the cyclone dust collector 61 is guided to the cyclone chamber 614 via the inlet part 612. The air guided to the cyclone chamber 614 flows upward while swirling along an outer circumferential surface of the grill portion 670.

Dust heavier than the air may be scattered to an outer side in a radial direction by a centrifugal force and introduced into the dust collecting chamber 615 via the opening 615*a* located at an upper portion of the cyclone chamber 614. The dust introduced into the dust collecting chamber 615 may fall due to its weight and may be collected in the dust collecting chamber 615.

The air from which the dust is removed for a first time by the centrifugal force in the cyclone chamber 614 may be filtered while passing through the air passing holes 672, and thus dust particles of a predetermined size or larger may be filtered out for a second time. The air passing through the air passing holes 672 may be guided upward via the outlet part 614*a*. Fine dust in the air guided toward the middle cover 611*a* via the outlet part 614*a* may be filtered out for a third time by the fine filter 68 provided on the middle cover 611*a*.

The finally cleaned air is discharged from the cyclone dust collector 61 via the exit 613 of the upper cover 611 and discharged to the outside of the main body 10 via the fan motor room (not shown). A filter (not shown) capable of filtering out dust in the air passing through the exit 613 may be further provided at a side of the exit 613 of the upper cover 611.

Figure 4:
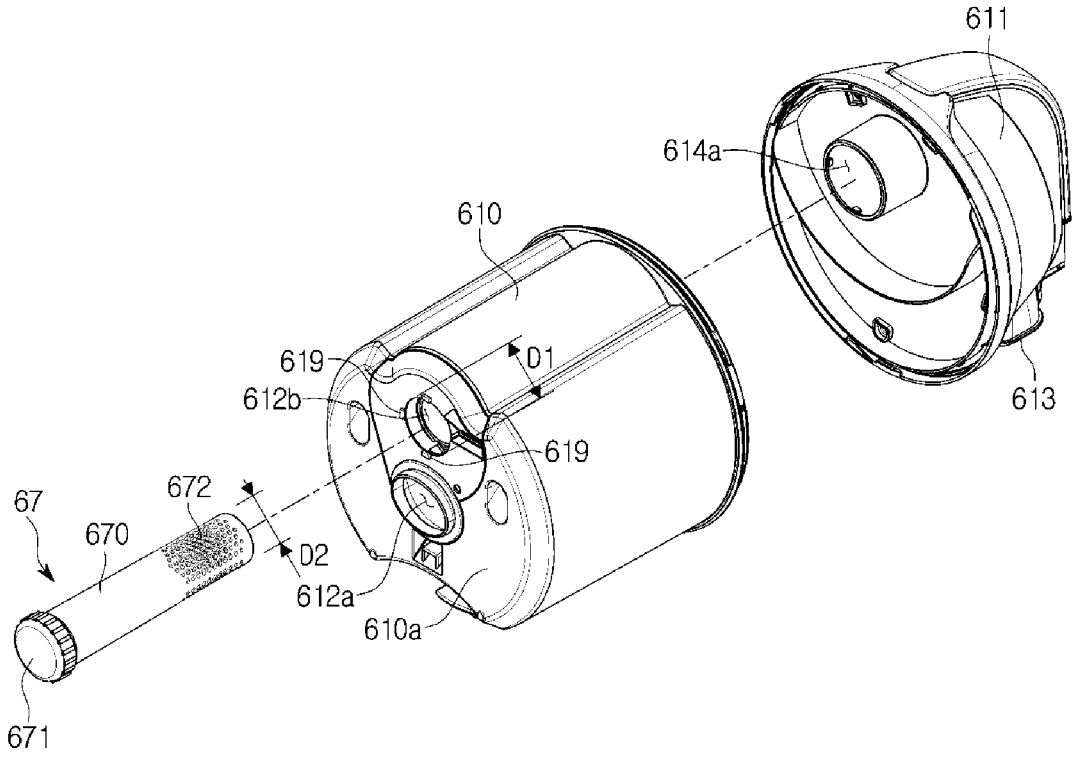
FIG. 4 is an exploded perspective view illustrating the case and the grill assembly of the cyclone dust collector according to one embodiment.

FIG. 4 is an exploded perspective view illustrating the case and the grill assembly of the cyclone dust collector according to one embodiment.

Referring to FIG. 4, the grill assembly 67 may be separably installed in the cyclone dust collector 61 according to one embodiment. The entrance 612*a* through which air is introduced and the opening 612*b* through which the grill assembly 67 is inserted may be formed in the case 610. The entrance 612*a* and the opening 612*b* may be formed in the lower cover 610*a*.

The opening 612*b* may be formed in a shape corresponding to a shape of an outside surface of the grill portion 670 such that the grill portion 670 may be inserted into the case 610. As one example, in the case in which the grill portion 67 is formed in the cylindrical shape, the opening 612*b* may be formed in a circular shape having the same diameter as the grill portion 67. A diameter D1 of the opening 612*b* may be the same as or slightly greater than a diameter D2 of the grill portion 670. The shape of the opening 612*b* is not limited to the shape described above. Hereinafter, the embodiment in which the grill portion 670 is formed in a cylindrical shape and the opening 612*b* is formed in a circular shape corresponding to the grill portion 670 will be described.

A coupling protrusion 619 configured to be coupled to the grill assembly 67 may be provided around the opening 612*b*. The coupling protrusion 619 may be provided to protrude from an outside surface of the lower cover 610*a*. A plurality of coupling protrusions 619 may be provided and disposed to be spaced a predetermined distance from each other around the opening 612*b*. In the case in which the opening 612*b* is formed in the circular shape, the coupling protrusions 619 may be disposed to be separated by the predetermined distance from each other in a circumferential direction of the opening 612*b*.

Figure 5:
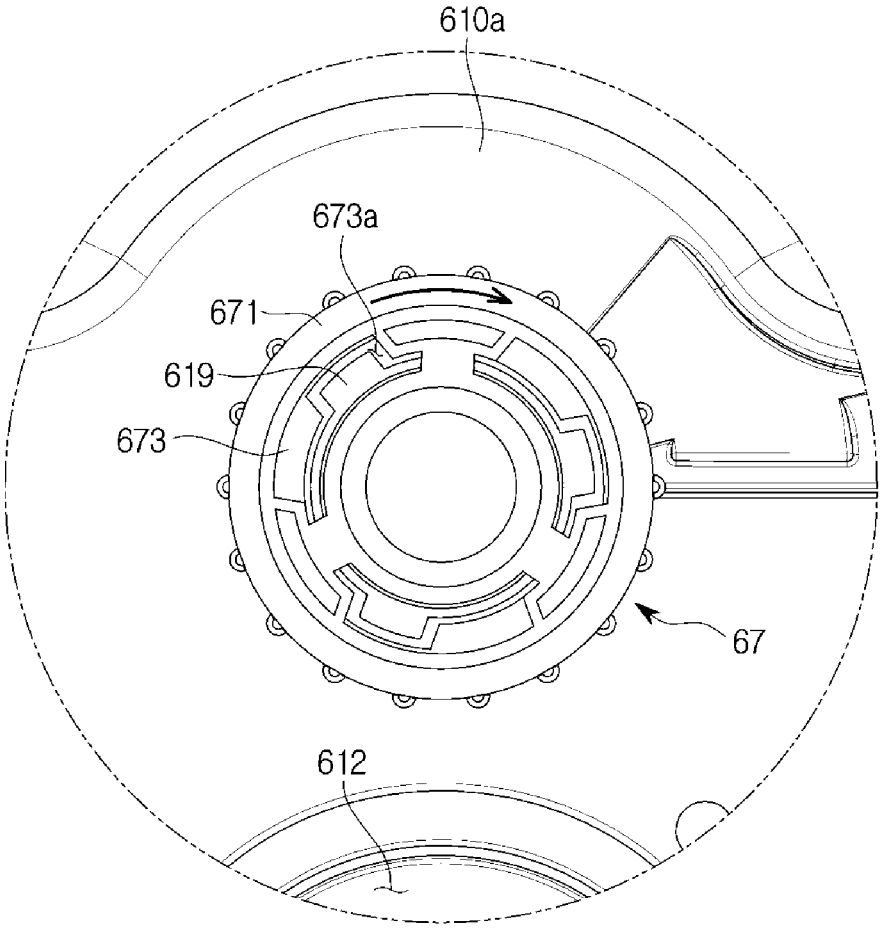
FIGS. 5 and 6 are views illustrating coupling portions of the grill assembly and the case according to one embodiment.
Figure 6:
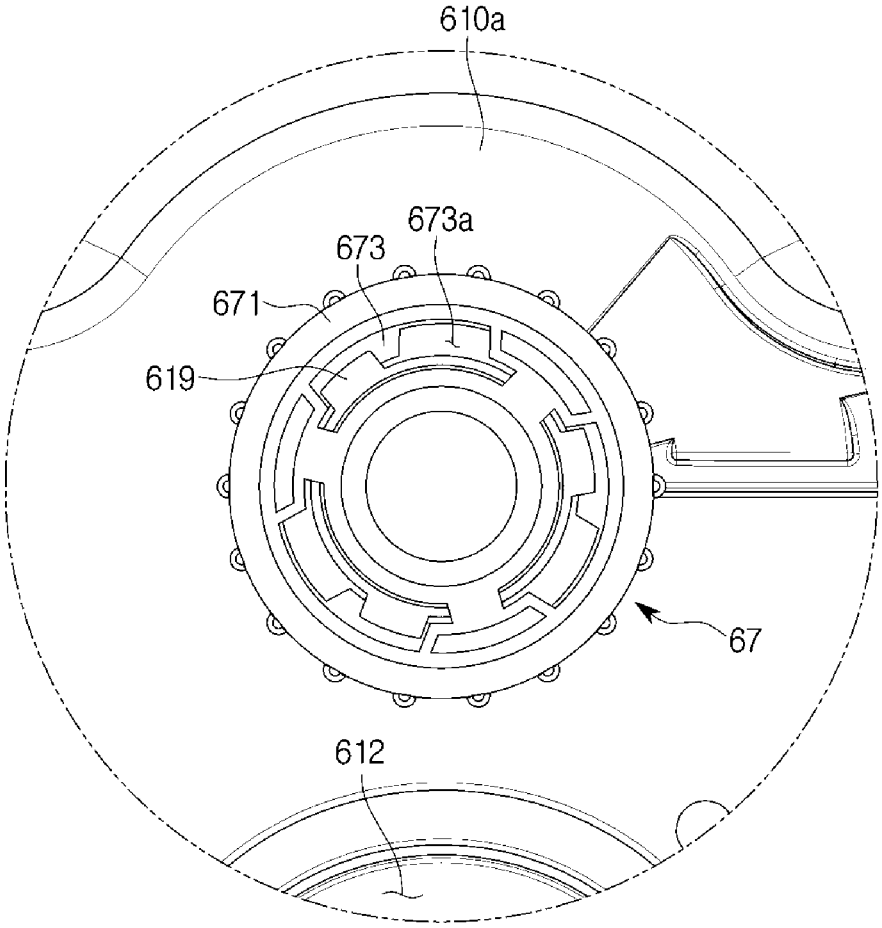

FIGS. 5 and 6 are views illustrating coupling portions of the grill assembly and the case according to one embodiment.

Referring to FIGS. 5 and 6, the grill assembly 67 according to one embodiment may include the grill portion 670 in which the air passing holes 672 are formed and the handle 671 provided at one side of the grill portion 67. When the grill assembly 67 is installed in the case 610, the handle 671 may be located outside the case 610 such that the user may manipulate the handle 671.

Irregularities may be formed on a surface of the handle 671 such that the user may easily manipulate the handle 671. The grill portion 670 and the handle 671 may be integrally injection molded.

The handle 671 may include insertion portions 673*a* into which the coupling protrusions 619 provided on the lower cover 610*a* may be inserted and interfering portions 673 configured to interfere with the coupling protrusions 619. The insertion portions 673*a* and the interfering portions 673 may be located to correspond to the coupling protrusions 619 provided on the lower cover 610*a*. In the case in which the opening 612*b* is formed in the circular shape and the coupling protrusions 619 are provided to protrude toward an outer side of a circumference of the opening 612*b*, the insertion portions 673*a* and the interfering portions 673 may also be disposed along a circumferential shape of the opening 612*b* to correspond to the opening 612*b* and the coupling protrusions 619.

In the case in which the plurality of coupling protrusions 619 are provided to be spaced the predetermined distance from each other in the circumferential direction of the opening 612*b*, a plurality of interfering portions 673 and a plurality of insertion portions 673*a* may also be provided, and the interfering portions 673 and the insertion portions 673*a* may be alternately provided to correspond to the coupling protrusions 619.

When the coupling protrusions 619 provided on the lower cover 610*a* are inserted through the insertion portions 673*a* and the grill assembly 67 is rotated in one direction, the coupling protrusions 619 may interfere with the adjacent interfering portions 673. The interfering portions 673 are interfered with by the coupling protrusions 619, and the grill assembly 67 may be installed in and locked by the case 610.

In order to separate the grill assembly 67 from the case 610, the grill assembly 67 may be rotated in the other direction. As the grill assembly 67 is rotated in the other direction, an interference state of the interfering portions 673 may be released. Accordingly, the locked state of the grill assembly 67 may be released, and the grill assembly 67 may be separated from the case 610.

A configuration in which the grill assembly 67 is coupled to or separated from the case 610 is not limited to the configuration described above. Although the embodiment in which the grill assembly 67 is installed in and separated from the lower cover 610*a* has been described as described above, in a case in which the lower cover 610*a* and the case 610 are integrally formed, the grill assembly 67 may also be regarded as being installed in and separated from the case 610.

Figure 7:
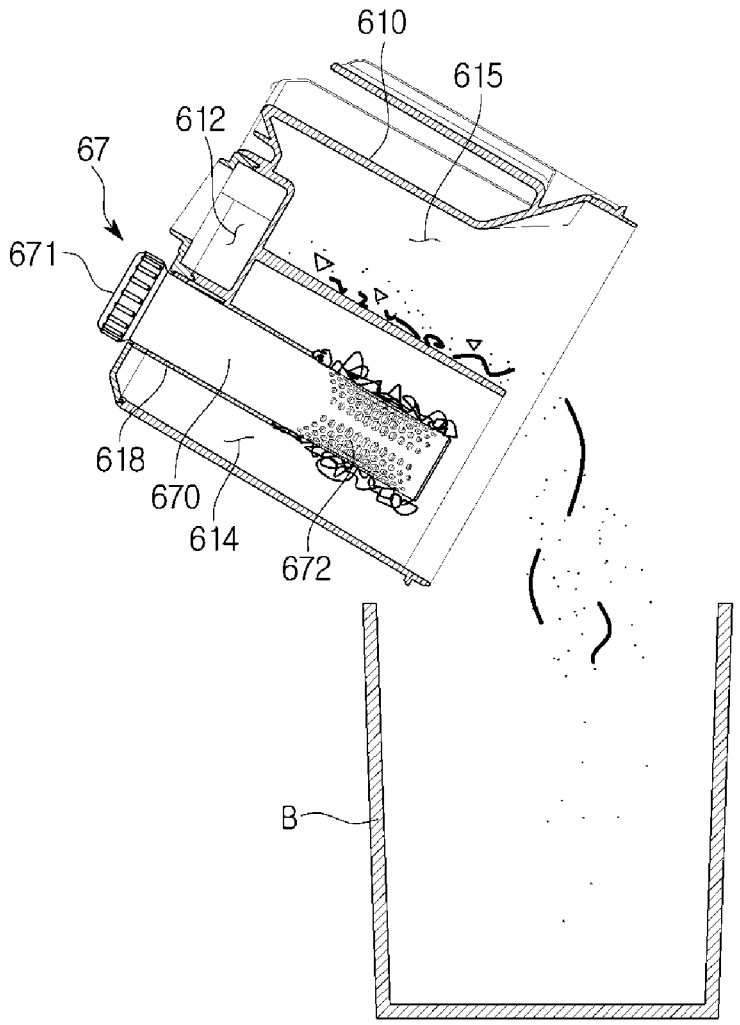
FIGS. 7 to 9 are views illustrating an aspect in which foreign material of a surface of the grill portion according to one embodiment is separated therefrom
Figure 8:
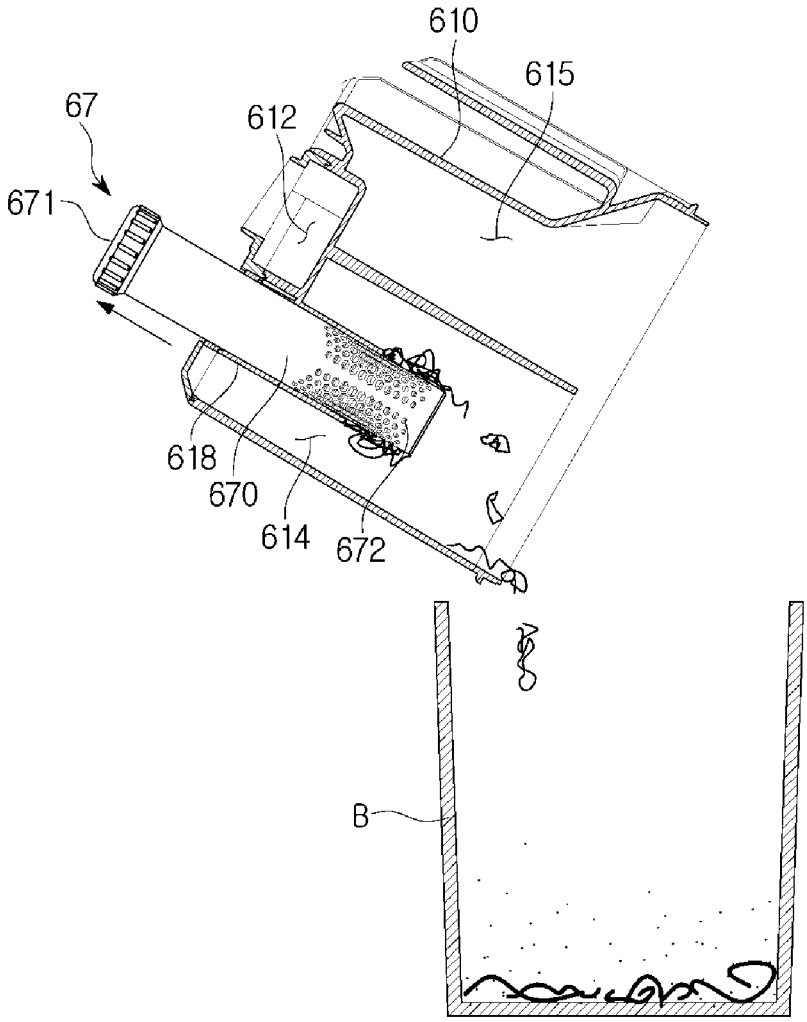
Figure 9:
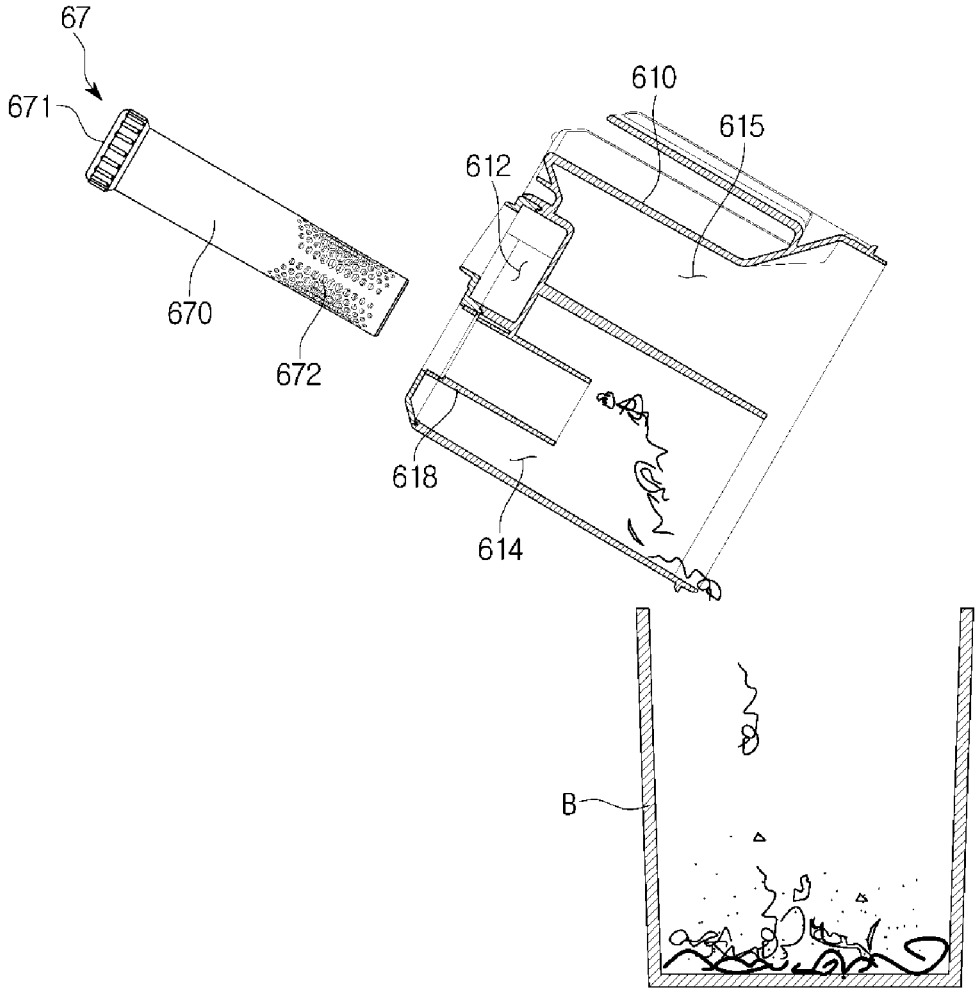

FIGS. 7 to 9 are views illustrating an aspect in which foreign material of a surface of the grill portion according to one embodiment is separated therefrom.

Referring to FIGS. 7 to 9, the grill assembly 67 according to one embodiment may be provided to be separable from the case 610. Hair, dust, and the like adhered to the surface of the grill portion 670 may be removed from the surface of the grill portion 670 as the grill assembly 67 is separated from the case 610.

The hair, dust, and the like removed from the surface of the grill portion 670 may be accommodated in the case 610. When the user empties the dust and the like out of the case 610, the user need not remove the hair, dust, and the like adhered to the surface of the grill portion 670 with his or her hands, but need only dump the dust accommodated in the case 610 in a wastebasket B.

The cleaning portion 618 may be provided at an inside surface of the case 610 to be adjacent to the opening 412. When the grill assembly 67 is separated from the case 610, the cleaning portion 618 is provided to interfere with hair, dust, and the like adhered to the surface of the grill portion 670. The hair, dust, and the like of the surface of the grill portion 670 may be removed from the surface of the grill portion 670 by the cleaning portion 618. The dust and the like removed from the surface of the grill portion 670 are not discharged through the opening 612*b* and remain in the case 610.

The cleaning portion 618 may be provided to come into contact with the surface of the grill portion 670. Although the cleaning portion 618 does not come into contact with the surface of the grill portion 670, the cleaning portion 618 may also be provided to be adjacent to the grill portion 670 to interfere with the hair, dust, and the like of the surface of the grill portion 670. In addition, the cleaning portion 618 may also not be provided, such that dust adhered to the surface of the grill portion 670 may be interfered with and removed by an inside surface of the opening 612*b*.

Hereinafter, the embodiment in which dust adhered to the surface of the grill portion 670 is removed by the cleaning portion 618 will be described.

In the cyclone chamber 614, a swirling air current may be generated, air from which dust is separated by the swirling air current may pass through the air passing holes 672 provided in the grill portion 670. The air passing through the air passing holes 672 may be discharged to the outside of the cyclone dust collector 61 via the outlet part 614*a*.

Hair, dust, and the like separated from the air by the swirling air current may be collected in the case 610. The user may separate the cyclone dust collector 61 from the extending pipe 63 and the handle pipe 64, open the cover 611, and empty the dust out of the case 610.

Here, the hair, dust, and the like may be adhered to the surface of the grill portion 670. Conventionally, a user removes hair, dust, and the like adhered to a surface of a grill portion 670 with his or her hands. As the hair, dust, and the like adhered to the surface of the grill portion 670 are removed, the removed dust may not be dumped in a wastebasket B and may instead be scattered around the wastebasket B, and thus secondary contamination may occur. In addition, since the hair, dust, and the like are removed by hands, it is not hygienic.

In the present disclosure, the grill portion 670 is provided to be separable from the case 610, and when the grill portion 670 is separated from the case 610, hair, dust, and the like adhered to the surface of the grill portion 670 are interfered with by the cleaning portion 618 and removed from the surface of the grill portion 670.

The user need not remove the hair, dust, and the like adhered to the surface of the grill portion 670 with his or her hands and may clean the surface of the grill portion 670 by only separating the grill portion 670 from the case 610. The user only empties the case 610 in which the dust removed from the surface of the grill portion 670 is accommodated.

The user may make a first opening 411 of the case 610 face the wastebasket B and separate the grill assembly 67 from the case 610 to dump foreign material in the case 610. Both of the dust collected in the case 610 and the dust removed from the surface of the grill portion 670 may be dumped in the wastebasket B.

As described above, since the grill assembly 67 of the cyclone dust collector 61 is separably provided, dust and the like of the surface of the grill portion 670 can be removed, and occurrence of secondary contamination around the wastebasket B can be prevented. In addition, since the user need not remove dust and the like with his or her hands by himself or herself, it is hygienic.

What is claimed:

1. A vacuum cleaner comprising a cyclone dust collector, wherein the cyclone dust collector includes:

a case configured to swirl suctioned air to separate dust from the suctioned air and accommodate the separated dust;

a grill assembly separably installed in the case, the grill assembly includes:

a grill portion in which an air passing hole is formed and which is accommodated in the case, and a handle provided at one side of the grill portion; and a cleaning portion included in the case and configured to remove dust adhered to a surface of the grill portion without contacting the surface of the grill portion when the grill assembly is separated from the case.

2. The vacuum cleaner of claim 1, wherein the case includes an upper cover provided above the case, and a lower cover coupled to a lower portion of the case to cover an open lower surface of the case.

3. The vacuum cleaner of claim 2, wherein the lower cover includes an entrance through which air is introduced into the case, and an opening through which the grill assembly is inserted.

4. The vacuum cleaner of claim 3, wherein the cleaning portion comprises a surface configured to contact a surface of the grill assembly such that the cleaning portion removes dust from the surface of the grill assembly during a process of separating the grill assembly from the case.

5. The vacuum cleaner of claim 3, wherein the cleaning portion is provided at an inside surface of the lower cover forming the opening.

6. The vacuum cleaner of claim 2, wherein:

the case further includes a middle cover interposed between the upper cover and the case to cover an upper surface of the case, and the middle cover is separably coupled to the case.

7. The vacuum cleaner of claim 6, wherein:

the cyclone dust collector includes a filter and the case includes a filter installation portion in which the filter is separably installed, and the filter installation portion is provided in the middle cover.

8. The vacuum cleaner of claim 1, further comprising a main body, wherein the cyclone dust collector is separably installed on the main body, and wherein the grill assembly is fixed to the case when the grill assembly is installed on the case, and the grill assembly is separable from the case when the cyclone dust collector is separated from the main body.

9. The vacuum cleaner of claim 1, wherein the cleaning portion is integrally formed with the case.

10. The vacuum cleaner of claim 1, wherein the cleaning portion is provided at an inside surface of the case.

11. The vacuum cleaner of claim 1, wherein a coupling protrusion is provided to protrude from an outside surface of the case.

12. The vacuum cleaner of claim 11, wherein the handle includes an interfering portion interfered with by the coupling protrusion.

13. The vacuum cleaner of claim 12, wherein the handle includes an insertion portion through which the coupling protrusion passes.

14. The vacuum cleaner of claim 13, wherein, when the coupling protrusion is inserted into the insertion portion and the handle is rotated in one direction, the coupling protrusion is interfered with the interfering portion and the grill assembly is fixed to the case.

15. The vacuum cleaner of claim 1, wherein the case includes a cyclone chamber in which introduced air swirls and a dust collecting chamber in which dust in the air is collected.

* * * * *